US008348481B2

(12) United States Patent
Chang

(10) Patent No.: US 8,348,481 B2
(45) Date of Patent: Jan. 8, 2013

(54) CEILING LAMP WITH A HOUSING LOCKABLE TO A FRAME

(75) Inventor: Kuo-Cheng Chang, Miao-Li Hsien (TW)

(73) Assignee: Foxsemicon Integrated Technology, Inc., Chu-Nan, Miao-Li Hsien (TW)

( * ) Notice: Subject to any disclaimer, the term of this patent is extended or adjusted under 35 U.S.C. 154(b) by 316 days.

(21) Appl. No.: 12/857,580

(22) Filed: Aug. 17, 2010

(65) Prior Publication Data

US 2012/0020094 A1 Jan. 26, 2012

(30) Foreign Application Priority Data

Jul. 26, 2010 (TW) ..... 99124486 A

(51) Int. Cl.
*F21V 15/01* (2006.01)

(52) U.S. Cl. ..... 362/404; 362/382; 362/362; 362/147

(58) Field of Classification Search ..... 362/382, 362/404, 362, 147, 430, 432, 438
See application file for complete search history.

(56) References Cited

U.S. PATENT DOCUMENTS

| | | | | |
|---|---|---|---|---|
| 2,288,941 | A * | 7/1942 | Curtis | 362/375 |
| 6,210,025 | B1 * | 4/2001 | Schmidt et al. | 362/362 |
| 7,329,026 | B1 * | 2/2008 | Hayman et al. | 362/277 |
| 7,946,738 | B2 * | 5/2011 | Fowler et al. | 362/374 |

* cited by examiner

*Primary Examiner* — Karabi Guharay
(74) *Attorney, Agent, or Firm* — Altis Law Group, Inc.

(57) ABSTRACT

A ceiling lamp includes a housing, a light source received in the housing, a transparent/translucent cover fixed to a bottom of the housing and a frame connected to the housing and located over the housing. The housing includes a top plate, a pair of wings extending downwardly from the top plate and two lids fixed to the top plate and the wings. The frame includes a top wall and two side walls and two arms extending downwardly from the top wall. Each lid forms a slot therein, and each arm forms a protrusion to engage in the slot to thereby secure the housing to the frame.

14 Claims, 5 Drawing Sheets

CEILING LAMP WITH A HOUSING LOCKABLE TO A FRAME

BACKGROUND

1. Technical Field

The present disclosure relates to a ceiling lamp, and more particularly, to a ceiling lamp which can be conveniently mounted on a ceiling.

2. Description of Related Art

As indispensable objects, lamps are widely used in people's daily life, and gradually developed to have more and more different types according to the exact environments where they are applied, including road lamp, tunnel lamp, underwater lamp, landscape lamp, parking lamp, vehicle lamp, washing lamp, ceiling lamp, traffic lamp, table lamp, mine lamp, etc.

For the lamps which are mounted at high levels, such as road lamp and ceiling lamp, it is desirable to have such lamps be easily installed so that the installing time can be reduced and the possibility of danger that the installing person falls from a high place is lowered. However, the conventional lamps generally need multiple processes to finish the installation thereof, extending the time of risk of the installing person exposed to the high level during installation of the lamps.

What is needed, therefore, is a ceiling lamp which can overcome the limitations described above.

BRIEF DESCRIPTION OF THE DRAWINGS

Many aspects of the present disclosure can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF THE EMBODIMENTS

Figure 1:
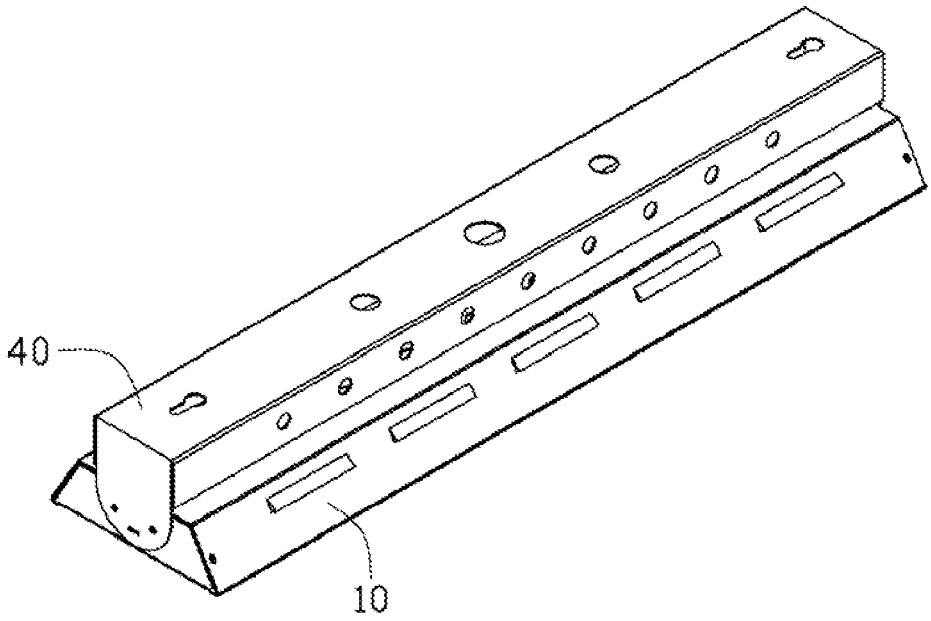
FIG. 1 is an exemplary view of a ceiling lamp of the present disclosure.
Figure 2:
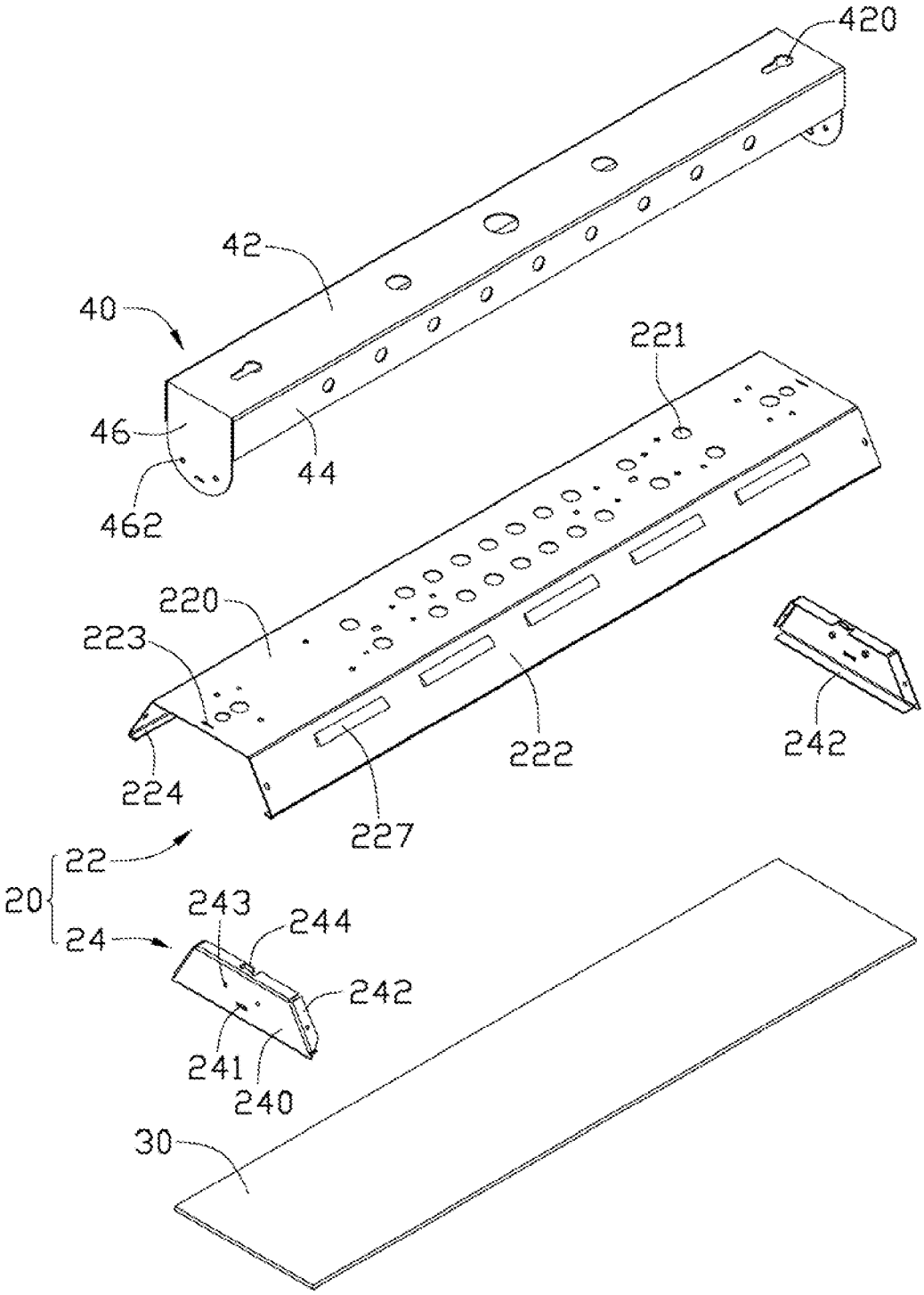
FIG. 2 is an exploded view of the ceiling lamp of FIG. 1.
Figure 3:
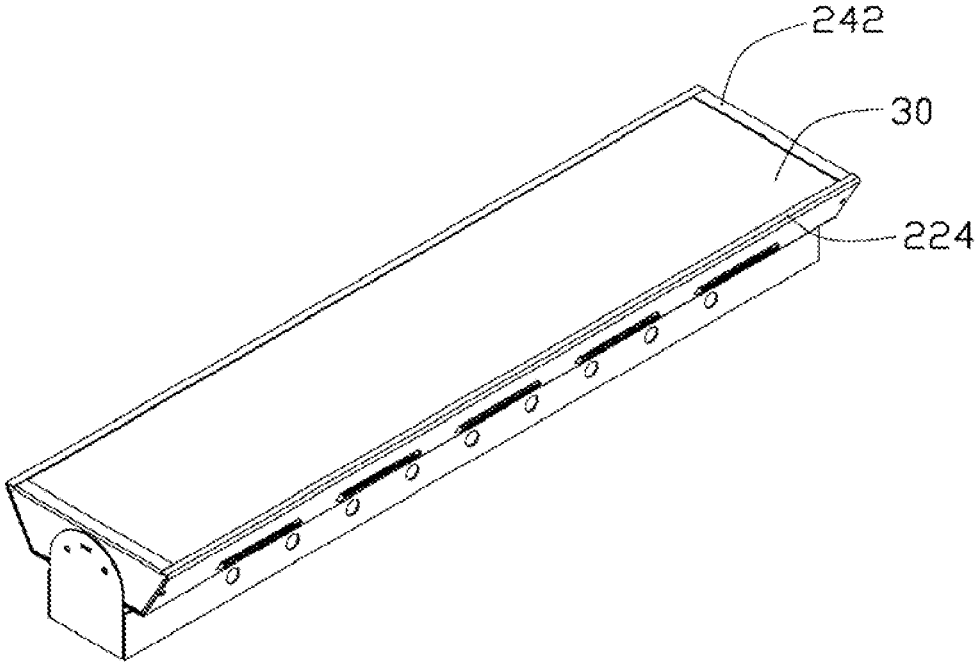
FIG. 3 is an inverted view of the ceiling lamp of FIG. 1.
Figure 4:
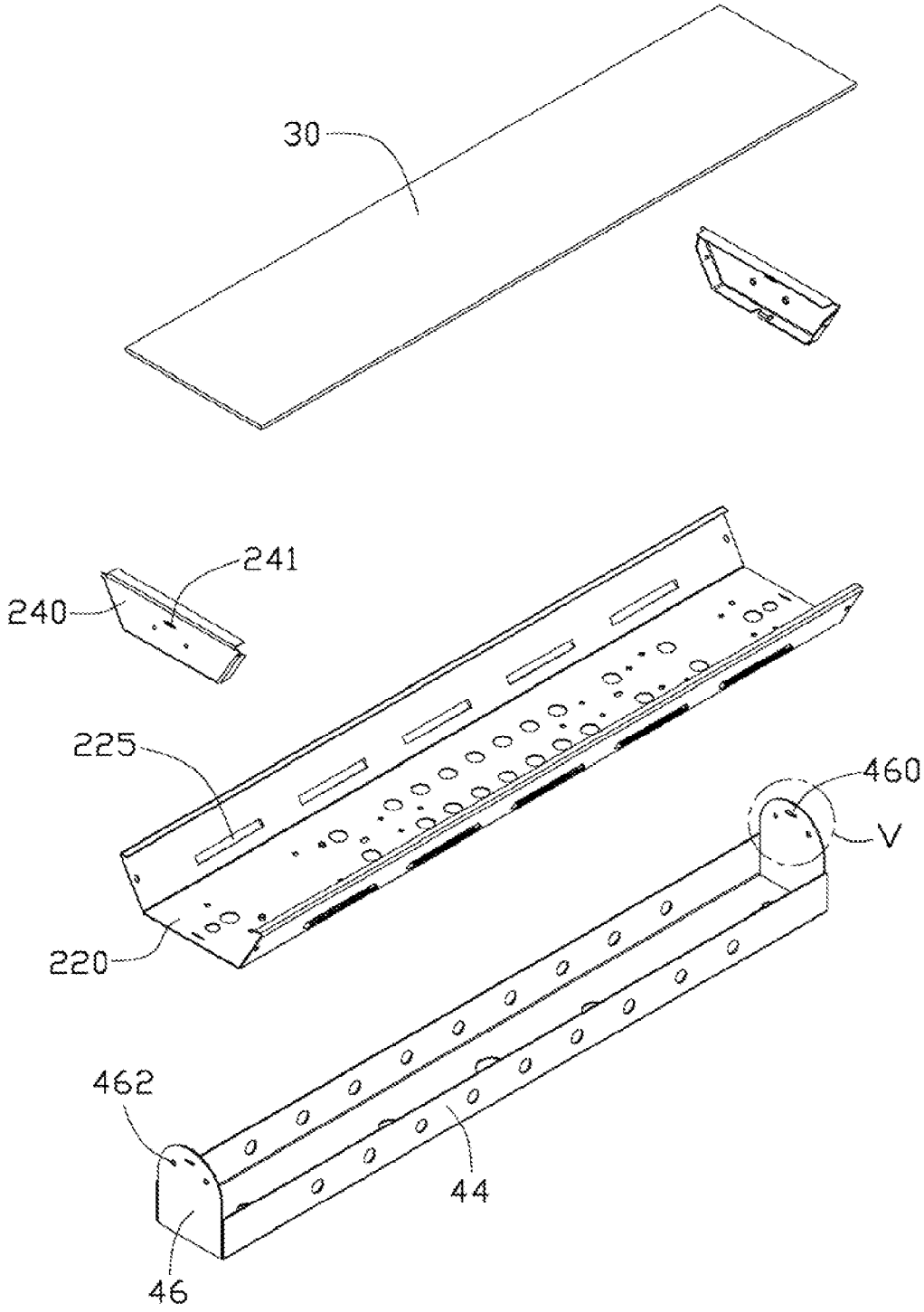
FIG. 4 is an inverted view of the ceiling lamp of FIG. 2.

Referring to FIGS. 1-4, a ceiling lamp of the present disclosure is illustrated. The ceiling lamp includes a lamp body 10 and a frame 40 connected to the lamp body 10 to mount the lamp body 10 to a ceiling (not shown) at a position below the ceiling. The lamp body 10 includes a housing 20, a light source (not shown) received in the housing 20 and a transparent/translucent cover 30 fixed to the housing 20 to cover the light source. The light source may be any suitable light sources such as fluorescent tube, incandescent bulb or LED modules. The housing 20 includes a lampshade 22 and a pair of lids 24 fixed to two opposite sides of the lampshade 22. The lampshade 22 is made of a metal sheet bent to the desired configuration. The lampshade 22 includes a rectangular top plate 220 and a pair of wings 222 extending downwardly and inclinedly from two opposite sides of the top plate 220. The top plate 220 defines a plurality of holes 221 therein, wherein some of the holes 221 are for allowing electrical wires (not shown) to extend therethrough into the housing 20 to connect with the light source, and the other holes 221 act as air passages to dissipate heat within the housing 20 to the outside environment. A pair of apertures 223 are defined adjacent to other two opposite sides of the top plate 220. The two wings 222 are integrally bent from the top plate 220 in a manner that each wing 222 defines an angle of 120 degrees with the top plate 220. Each wing 222 has a plurality of openings 225 aligned in a line near the top plate 220 and along a long side thereof (see FIG. 4), for further dissipating heat from the light source to the outside environment. Each opening 225 has a canopy 227 formed from a top edge thereof, for preventing surrounding dust from directly falling into the housing 20 through the opening 225. Each wing 222 forms a flange 224 extending inwardly and horizontally from a bottom thereof, for holding the cover 30 within the housing 20.

Each lid 24 includes a trapezoid baffle plate 240 and four flanges 242 extending inwardly and horizontally from four sides of the baffle plate 240, respectively. The baffle plate 240 has a slot 241 defined near a bottom thereof and two holes 243 above the slot 241. An upper flange 242 and two lateral flanges 242 of each lid 24 abut against inner circumference of the top plate 220 and the two wings 222, respectively, to position each lid 24 to the lampshade 22 A middle portion of the upper flange 242 of each lid 24 is bent upwardly to form a tab 244 which is inserted into a corresponding aperture 223 in the top plate 220, for facilitating positioning of the lid 24 to the top plate 220. Screws (not shown) can be further extended through the top plate 220 and the two wings 222 into the upper and lateral flanges 242 of the lids 24, to fix the two lids 24 to the top plate 220 and the two wings 222. A lower flange 242 of each lid 24 supports the cover 30 thereon, to thereby fix the cover 30 within the housing 20 together with the flanges 224 on the wings 222.

The cover 30 is made of transparent/translucent material such as glass or plastic. The cover 30 is supported by the flanges 242 of the lids 24 and the flanges 224 of the lampshade 22 to cover the housing 20, whereby the light source received within the housing 20 can be protected from the outside environment.

Figure 5:
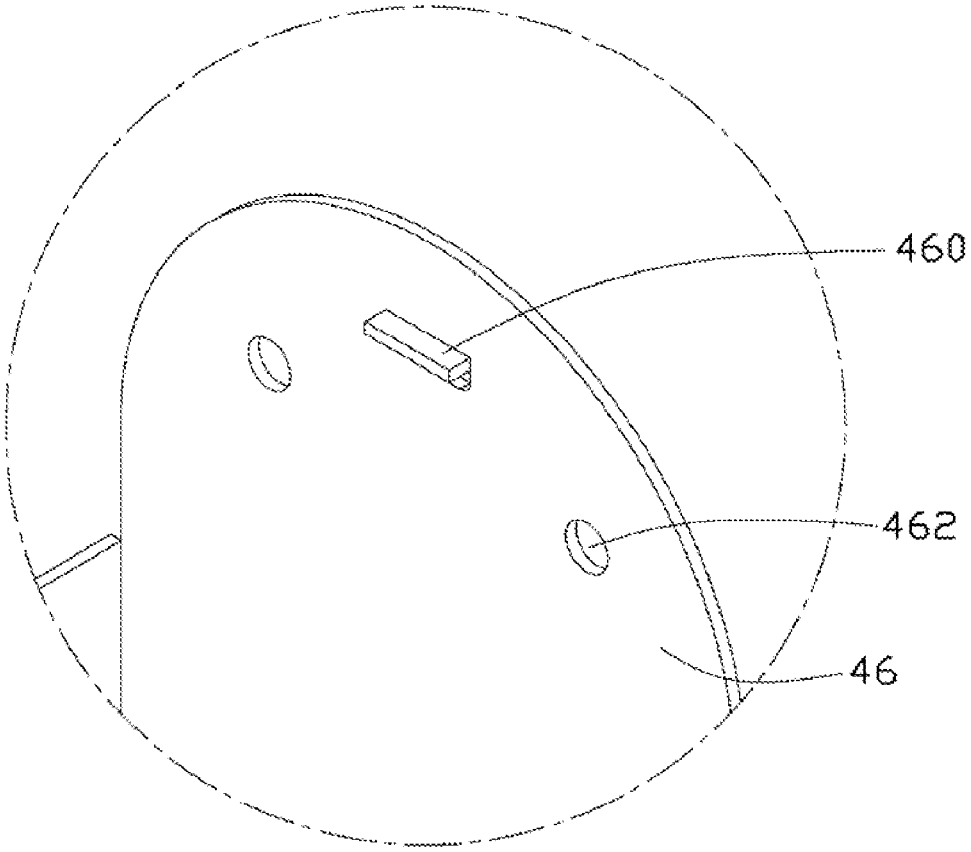
FIG. 5 shows an enlarged part V of the ceiling lamp of FIG. 4.

Also referring to FIG. 5, the frame 40 includes a top wall 42, a pair of side walls 44 extending downwardly and perpendicularly from two opposite sides of the top wall 40 and a pair of arms 46 extending downwardly and perpendicularly from other two opposite sides of the top wall 42. A plurality of holes 420 are defined in the top wall 42. Brackets (not shown) fixed on the ceiling can be engaged in the holes 420 to hang the lamp below the ceiling. Each arm 46 has an upper portion interconnecting the top wall 42 and the two side walls 44, and a lower portion extending downwardly beyond the two side walls 44. The upper portion of each arm 46 is rectangular, and the lower portion of each arm 46 has a profile similar to a semicircle. A part of the lower portion of each arm 46 is punched inwardly to form a protrusion 460 (see FIG. 5). The housing 20 can be conveniently assembled to the frame 40 by engaging the protrusions 460 into the slots 241 of the lids 24 of the housing 20, respectively. A pair of through holes 462 are defined in each arm 46 adjacent to the protrusion 460. The pair of through holes 462 in each arm 46 are aligned with the two holes 243 in each lid 24, respectively. Screws (not shown) can be extended through the through holes 462 of the arms 46 into the holes 243 of the lids 24 after the protrusions 460 are inserted into the slots 241, for reliably securing the housing 20 to the frame 40.

It is believed that the present disclosure and its advantages will be understood from the foregoing description, and it will be apparent that various changes may be made thereto without departing from the spirit and scope of the present disclosure or sacrificing all of its material advantages, the examples hereinbefore described merely being preferred or exemplary embodiments.

What is claimed is:

1. A ceiling lamp comprising:

a housing comprising a top plate and a pair of lids located at two opposite sides of the top plate, the housing being configured for receiving a light source therein; and a frame comprising a top wall and a pair of arms extending downwardly from two opposite sides of the top wall;

wherein each of the lids has a first fixing portion, and each of the arms forms a second fixing portion, the first fixing portion being locked with the second fixing portion to secure the housing to the frame;

wherein the housing further comprises a pair of wines extending downwardly from other two opposite sides of the top plate; and wherein each of the wines has a plurality of openings defined therein and a plurality of canopies each formed on a top edge of a corresponding opening.

2. The ceiling lamp as claimed in claim 1, wherein the top plate defines a plurality of holes therein.

3. The ceiling lamp as claimed in claim 1, wherein each of the pair of wings is oblique with respect to the top plate.

4. The ceiling lamp as claimed in claim 1, wherein each of the wings has a flange extending inwardly and horizontally from a bottom thereof, the flange being parallel to the top plate.

5. The ceiling lamp as claimed in claim 4, wherein the lids are detachably fixed to the top plate and the wings.

6. The ceiling lamp as claimed, in claim 5, wherein each of the lids comprises a baffle plate and a plurality of flanges extending from a periphery of the baffle plate, the first fixing portions being formed on the baffle plates, respectively.

7. The ceiling lamp as claimed in claim 6, wherein each of the lids has a tab bent from an upper one of the flanges thereof, the tab being inserted into the top plate.

8. The ceiling lamp as claimed in claim 6 further comprising a light pervious cover supported by the flanges of the wings and lower ones of the flanges of the lids.

9. The ceiling lamp as claimed in claim 1, wherein the frame further comprises a pair of side walls extending downwardly from other two opposite sides of the top wall.

10. The ceiling lamp as claimed in claim 9, wherein each of the arms has an upper portion interconnecting the side walls and a lower portion extending downwardly beyond the side walls, the second fixing portions being formed on the lower portions of the arms, respectively.

11. The ceiling lamp as claimed in claim 1, wherein the first fixing portion is a slot and the second fixing portion is a protrusion.

12. A ceiling lamp comprising:

a housing comprising a top plate, a pair of wings extending downwardly from two opposite sides of the top plate and a pair of lids fixed to the top plate and the two wings, the housing being configured for receiving a light source therein; and a frame comprising a top wall, a pair of side walls extending downwardly from two opposite sides of the top wall and a pair of arms extending from other two opposite sides of the top wall;

wherein each of the arms has a protrusion extending inwardly to be inserted into each of the lids, to thereby fix the frame to the housing;

wherein a plurality of openings are defined in the housing and a plurality of canopies are formed on top edges of the plurality of openings, respectively.

13. The ceiling lamp as claimed in claim 12, wherein each of the arms has an upper portion interconnecting the two side walk and a lower portion extending downwardly beyond the two side walls, the protrusion being formed on the lower portion of each of the arms.

14. The ceiling lamp as claimed in claim 12, wherein each of the lids has a tab extending into the top plate of the housing.

* * * * *